United States Patent [19]

Nguyen

[11] Patent Number: 4,968,386

[45] Date of Patent: Nov. 6, 1990

[54] APPARATUS FOR DETERMINING AMPLITUDE AND FREQUENCY OF WEB FLUTTER

[75] Inventor: Dong D. Nguyen, Lawrenceville, N.J.

[73] Assignee: Union Camp Corporation, Wayne, N.J.

[21] Appl. No.: 192,255

[22] Filed: May 10, 1988

[51] Int. Cl.[5] ..... D21F 7/06

[52] U.S. Cl. ..... 162/262; 73/37.7; 73/159; 162/256; 162/263; 226/100; 242/57

[58] Field of Search ..... 162/198, 263, 256, 273, 162/255, 262, DIG. 10, 272; 73/37.6, 37.7, 159; 242/57; 226/100

[56] References Cited

U.S. PATENT DOCUMENTS

| | | | |
|---|---|---|---|
| 4,031,741 | 6/1977 | Schaming | 73/37.7 |
| 4,179,330 | 12/1979 | Page . | |
| 4,425,809 | 1/1984 | Bakel et al. | 73/37.7 |
| 4,496,428 | 1/1985 | Wells . | |
| 4,501,642 | 2/1985 | Wells . | |
| 4,523,451 | 6/1985 | Boster | 73/37.6 |
| 4,637,727 | 1/1987 | Ahola et al. . | |

FOREIGN PATENT DOCUMENTS

| | | | |
|---|---|---|---|
| 904574 | 7/1972 | Canada | 162/255 |

OTHER PUBLICATIONS

Pramila, Antti, "Sheet Flutter and the Interaction Between Sheet and Air", Tappi Journal, pp. 70–74 (Jul., 1986).

Smook, G. A., Handbook for Pulp & Paper Technologists, Tappi, Atlanta, Ga., Chapter 17, 1982 U.S.A. pp. 244–254.

*Primary Examiner*—Steve Alvo

*Attorney, Agent, or Firm*—Edward J. Sites

[57] ABSTRACT

An apparatus and method for determining the frequency and amplitude of flutter of a moving web in a web manufacturing operation, is shown to include a sensor for sensing the pressure of air in a region proximate the web and for generating a pressure signal reflective of the air pressure and a signal processor, connected to receive the pressure signal, for determining the amplitudes and frequencies of the flutter from the pressure signal and for generating an indication signal representative of the flutter amplitude and frequency.

20 Claims, 3 Drawing Sheets

APPARATUS FOR DETERMINING AMPLITUDE AND FREQUENCY OF WEB FLUTTER

FIELD OF THE INVENTION

The present invention relates to the field of manufacturing web products, and more particularly to methods and apparatus for monitoring a moving web during the manufacturing process.

BACKGROUND OF THE INVENTION

In the manufacture of web based products, such as paper, textiles and certain plastics, a web of material is moved along a serpentine path through various stations wherein a different manufacturing operation is performed on the web at each station. The total length of a web moving through such a path can measure several hundred feet and can measure several feet in width. Should the web break during the manufacturing process, significant downtime can occur while the web is rethreaded through the different stations. As will be appreciated, such downtime can result in substantial cost to the manufacturer. An additional consequence of a web break is the detrimental effect on product quality if breaks are occurring too frequently.

Therefore, a need exists in the manufacture of web based products for methods and apparatus for preventing web breaks. One aspect of the invention described and claimed herein is the prevention of such breaks through the investigation of web flutter. Flutter is that phenomenon where the web moves in a direction substantially perpendicular to the direction of travel, which movement has one or more amplitudes and frequencies. Since touching the web during production is to be avoided, if possible, it will be important to determine web flutter in a fashion which does not contact the web.

Devices have been previously disclosed for the determination of web flutter in a non-contact fashion. U.S. Pat. No. 4,496,428 — Wells and related U.S. Pat. No. 4,501,642 — Wells discuss the use of reflected light in order to determine the amplitude and frequency of web flutter during paper manufacture so that tension in the paper web can be maintained at some desired level. Basically, it appears that light is projected from a source, mounted adjacent the paper path, onto a moving web. The source is mounted so that the reflection is directed onto an optoelectronic detector. Frequency is said to be determined from the time it takes the reflected light to scan back and forth across the detector. Amplitude is determined from the magnitude of the reflected light. Although this patent suggests the use of radar or ultrasonic devices for determining flutter, no method or apparatus is disclosed.

U.S. Pat. No. 4,637,727 — Ahola et al. also discusses the use of light to make a non-contact determination of web flutter. It is said in that patent that the minimization of flutter results in the probability of a web break being smaller. Basically, it appears that flutter amplitude and frequency are determined through the use of a high frequency distance measuring scheme. A light pulse is reflected off a moving paper web and directed onto a photodiode. The time it takes the light to travel from its source to the photodiode is measured. Over a period of time, sufficient measurements can be made to determine the frequency and amplitude of web flutter. This patent also suggests the use of capacitance or ultrasound to determine web flutter. However, for different reasons, each of these techniques is rejected in favor of the light-based technique.

The problem with these previously described devices is that they do not appear to be pracatical in the manufacturing environment. For example, in the manufacture of paper it will be necessary to determine flutter within web pockets where temperatures can reach 180° F. or higher. Also, if a web break occurs in or around the region where flutter is being determined the device being used can be struck either by the advancing web or by the end of the web, i.e., the break tail. The forces involved in such contacts can be significant enough to damage light-based devices. Moreover, and perhaps more significant, is the fact that since the prior devices were based on wave reflection from the surface of the web, the stationary sensors of such prior devices were not capable of reliable detection. This key deficiency is the result of the incidental web surface not being normal to the sensor as will occur as a result of flutter.

It is also a practice in web manufacturing that if flutter appears to be too severe such that a web break or excessive wrinkling is feared, the flutter is reduced by slowing the movement of the web through the machinery. As will be appreciated, the slowing of the web results in the manufacturing equipment being operated at less than capacity, which is economically undesirable.

Consequently, a need still exists for a method and apparatus to determine web flutter in a manufacturing environment, which method will remain reliable even in the presence of varying amount of flutter.

SUMMARY OF THE INVENTION

The invention comprises an apparatus and method for determining the frequencies and amplitudes of flutter of a moving web in a web manufacturing operation, is shown to include a sensor for sensing the pressure of air in a region proximate the web and for generating a pressure signal representative of the air pressure and a signal processor, connected to receive the pressure signal, for determining the amplitudes and frequencies of the flutter from the pressure signal and for generating an indication signal reflective of the flutter amplitude and frequency. Such apparatus and method can also be utilized for data acquisition purposes to develop web history.

DETAILED DESCRIPTION OF THE INVENTION

Although the present invention may be used to determine flutter in industries involved with web processing technology, for the purposes of illustration the invention will be described as used in a paper manufacturing operation.

In a paper manufacturing process a number of different operations are performed on a moving web at various stations. Although flutter can be measured in any one of those stations, the description will be limited herein to the determination of flutter in the dryer portion of a paper manufacturing process. In the dryer portion the objective is to evaporate residual moisture in the pressed web at an efficient rate and at low steam usage. Any edge cracks or wrinkles formed during such evaporation in the dryer can be the cause of web breaks in subsequent processing sections. Since web wrinkles are believed to be related to flutter, the characterization of the amplitude and frequency of flutter in the dryer can provide valuable web break prevention information.

Figure 1:
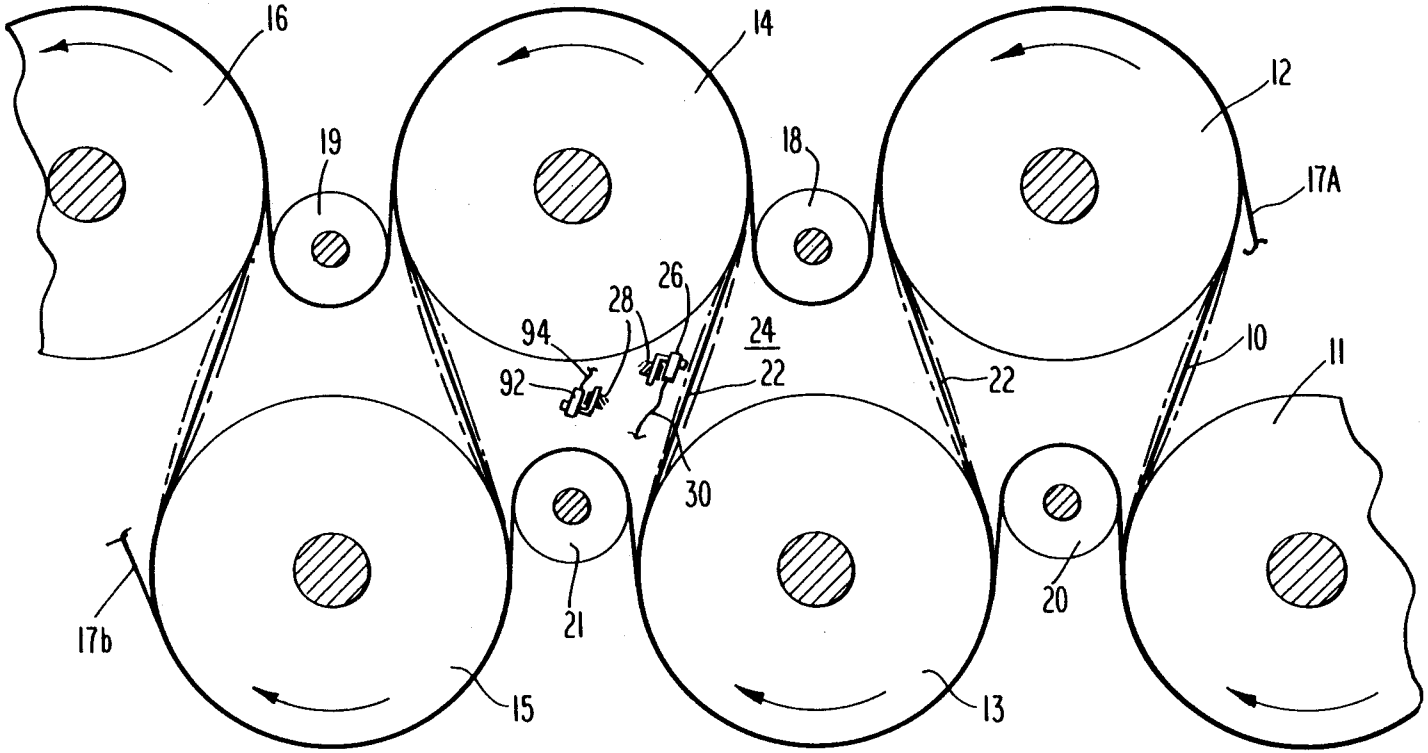
FIG. 1 is a plan view of a portion of a dryer used in a paper manufacturing operation having the sensor portion of the present invention mounted therein.

As shown in FIG. 1, a wet paper web 10, which has been previously pressed and now contains approximately 60 percent moisture, is passed over a series of steam heated drying cylinders or cans 11, 12, 13, 14, 15 and 16. Typically, the cans are approximately 60 to 72 inches in diameter. As web 10 passes over the cans, moisture is evaporated and carried away by ventilation air. Web 10 is held tightly against the cans 11–16 by a synthetic permeable fabric, so-called dryer felts 17*a* and 17*b*. Felt 17*a* presses web 10 against the surface of cans 12, 14 and 16 and passes over felt turning rolls 18 and 19. Likewise felt 17*b* presses web 10 against cans 11–13 and 15 and passes over felt turing rolls 20 and 21. Although cans 11–16 and rolls 18–21 are shown to be disposed on spindles, it will be understood that several techniques for rotational mounting are known.

As web 10 passes through the dryer portion shown in FIG. 1, that portion of the web between top and bottom cans, for example cans 13 and 14, the so-called draw portion 22, will flutter within dryer pocket 24. In the drying operation, water is removed via drying from web 10 in its draw portion 22, and this water vapor is vented away. A sensor 26, which may be mounted on an extension rod for relative stationary positioning, is shown to be mounted on frame 28 with the sensor protruding into dryer pocket 24 in order to generate an electrical signal reflective of the amplitude and frequency of the flutter of the 13–14 draw. The electrical signal is carried by leads 30 to processing components described in reference to FIG. 2.

While previous discussions of techniques to determine the amplitude and frequency of flutter have described complex and relatively delicate optical devices or have suggested other transmitting and receiving type equipment, I have found that one can passively determine flutter without contacting the web by sensing the fluctuating or modulating air pressure in the region proximate the web.

Figure 2:
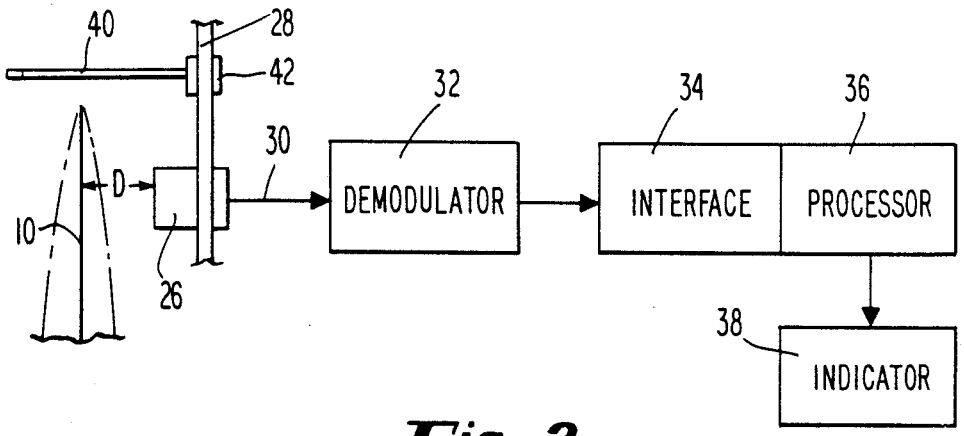
FIG. 2 is a diagrammatic view of the present invention.

As shown in FIG. 2, a sensor 26, which may be mounted on an extension rod for relative stationary positioning, is shown to be securely mounted on frame 28 and positioned proximate to web 10. While the method for mounting sensor 26 on frame 28 will be discussed more particularly in connection with FIG. 4, such mounting can be accomplished by any suitable method such as clamping. Sensor 26 is spaced a distance D from web 10, which distance in the preferred embodiment is approximately 3.00 inches.

As web 10 flutters the air pressure in the region proximate to the web will modulate in proportion to such flutter. Sensor 26 senses the air pressure in the region proximate to the web and generates an electrical signal which is reflective of the modulating air pressure, which signal in turn is also reflective of the amplitude and frequency of the flutter. In the preferred embodiment sensor 26 is a low differential pressure transducer such as the DP45 sold by Validyne Engineering Corporation of Northridge, California. Although such transducers are particularly specified for determining low differential air pressure conditions, such as that found in so-called "clean room" applications, I have discovered that this sensor is also useful to detect modulating air pressure in one of the pockets of a paper manufacturing dryer, where flutter frequency is believed not to exceed approximately 100 Hz. As will be appreciated in connection with FIG. 4, this sensor is also preferred because of its ability to withstand not only the environment in a paper manufacturing operation, but also its believed ability to withstand the consequences of a web break.

Referring again to FIG. 2, the signal generated by sensor 26 is a modulated electrical signal which is provided on leads 30 to demodulator 32, which demodulates the sensor signal and presents the demodulated signal to an interface 34. Interface 34 serves to format the demodulated signal into a digital form and buffer the digital signal prior to its presentation to processor 36. In the preferred embodiment, demodulator 32 is a CD12 Transducer Indicator sold by Validyne Engineering Corporation of Northridge, California, and interface 34 is an R300 Digital Signal Processor interface board sold by Rapid Systems, Inc. of Seattle, Washington. Such interface boards are designed for insertion into so-called "desk top" computers such as those made by IBM Corporation of Pughkeepsie, NY or so-called "IBM compatible" computers with 640 kBytes of random access memory.

Processor 36 in the preferred embodiment can be any one of the above computers into which the R360 Real Time Spectrum Analyzer also sold by Rapid Systems, Inc. has been installed. Processor 36 can be replaced by any dedicated vibration analyzer capable of processing low frequency vibrations, i.e., vibration frequency as low as 0.10 Hz. Processor 36 performs a fast Fourier transformation on the demodulated signal passing through interface 34, transforming the signal from the time domain to the frequency domain. Such a transformation results in a signal which is directly indicative of frequency and sheet acceleration. Since the sensor signal at this point is essentially proportional to web acceleration, it will be necessary to integrate this signal twice. Such an integration operation will convert the acceleration based signal to displacement or true amplitude. For a periodic signal, this mathematical operation can be achieved simply by dividing the voltage signal by the square of the corresponding frequency.

Processor 36 can be utilized with signal analysis software to perform the transformation and generate an indication signal which is presented to indicator 38 which depicts the frequency domain signal in terms of amplitude versus frequency. Indicator 38 can have any one of several forms such as an oscilloscope, a graphic printer or a cathode ray tube (CRT) display. For purposes of the present description, indicator 38 is a graphic printer which depicts the transformed signal in a form such as that shown in FIG. 3.

Figure 3:
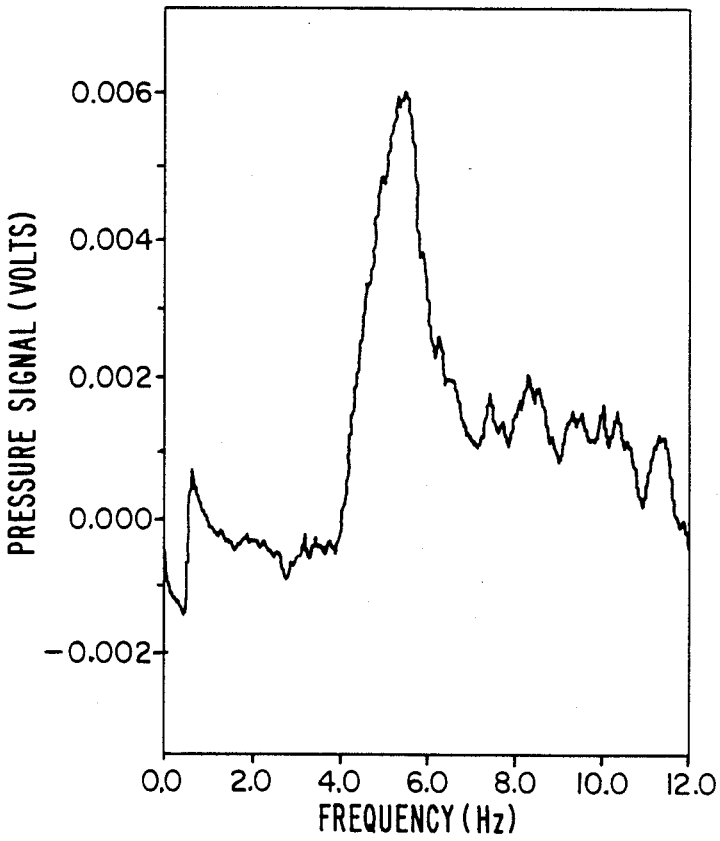
FIG. 3 is a graph of the amplitude and frequency of typical paper web flutter.

With reference to FIG. 3, the transformed signal is depicted over a predetermined time period as having a number of frequencies (shown along the X axis) with each frequency having an amplitude. Since the amplitude is a voltage which is proportional to web movement, it may be necessary to relate this amplitude to the actual distance web 10 has moved from its center position, for example for calibration purposes. As shown in FIG. 2, a distance indicating device (40), a ruler, is mounted on frame 28 by a suitable clamp 42. Ruler 42 is mounted transverse to the direction of flutter or generally perpendicular to the direction of movement of web 10. If the edge of web 10 is viewed in the vicinity of the ruler, a determination can be made of the maximum distance web 10 moves from its center position. This maximum distance can be related to the maximum amplitude voltage for the same time period indicated on indicator 38, or can be compared with the video signal of a high speed video camera.

By considering flutter over a predetermined period of time, a method for preventing web breaks becomes possible. In effect a web flutter history is developed which includes the frequency and amplitude of flutter of web 10 over a predetermined period of time. This history is assembled by sensing the pressure of air in a region proximate web 10 and generating a pressure signal reflective of the air pressure, or next determining the amplitude and frequency of the flutter from the pressure signal in the computer and generating an indication signal reflective of the amplitude and frequency. This information, i.e., the indication signals over a predetermined period of time, can be stored in the computer.

Figure 4:
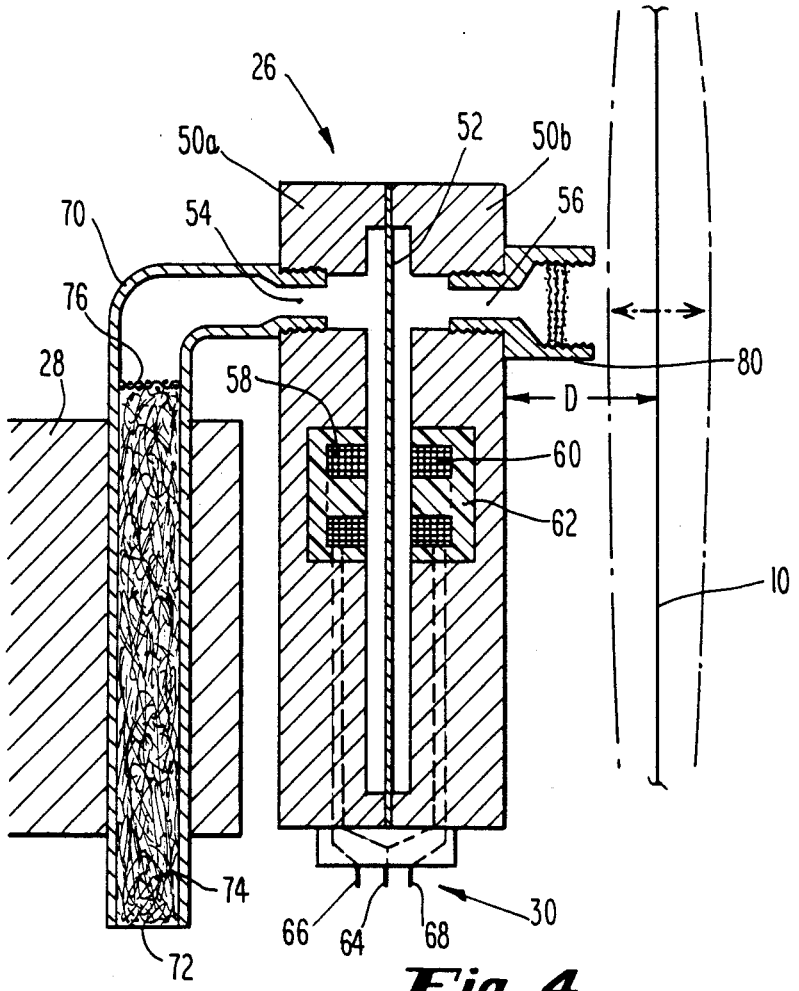
FIG. 4 is a section view of the preferred embodiment of the sensor used to determine flutter in accordance with the present invention.

Consider now the details of sensor 26 shown in FIG. 4. Sensor 26 is shown to include two body halves 50*a* and 50*b* which are joined in any suitable manner so that metal diaphragm 52 is sandwiched in between and defining cavities between diaphragm 52 and body halves 50*a* and 50*b*. Openings 54 and 56 are provided in body halves 50*a* and 50*b*, respectively, to allow the ingress and egress of air to the cavities. Coils 58 and 60, having matched impedance, are connected in series and positioned on either side of and equally spaced from diaphragm 52. Coils 58 and 60 are disposed with a dielectric material 62 and are held firmly in place within body halves 50*a* and 50*b*. Leads 30 are shown to include lead 64, which is conductively connected to the interconnection between coils 58 and 60, lead 66 and lead 68, which are connected to the ends of coils 58 and 60, respectively.

When the coils are excited, in any known manner, movement of diaphragm 52 towards or away from the coils will create an impedance imbalance generating a signal reflective of such imbalance. Since the movement of diaphragm 52 is caused by a difference in air pressure present in openings 54 and 56, which difference will be seen to be reflective of the air pressure proximate web 10, and since the air pressure proximate web 10 is representative of the amplitude and frequency of web flutter, the signal generated by the movement of diaphragm 52 is representative of the amplitude and frequency of web flutter.

In order to assure that the difference in pressure between openings 54 and 56 is representative of the air pressure proximate web 10, a tube 70 is threadingly engaged in opening 54 and which has an open end 72. Tube 70 is filled with a fiberglass material 74. The positioning of open end 72 a distance from opening 56 and the filling of tube 70 with material combine to assure that an ambient or relatively constant air pressure is present in opening 54. A mesh screen 76 is provided in tube 70 to prevent any particles present in the dryer atmosphere from entering the sensor. Tube 70 also serves to mount sensor 26 onto frame 28 through its attachment thereto, or sensor 26 may be mounted to an extension rod (not shown) to position sensor 26 closer to web 10. Additionally, sensor 26 can, if desired, be mounted independent of the frame on for example a tripod. As indicated previously such attachment can be from any suitable means such as a clamp or even frictional engagement as shown in FIG. 4.

Figure 5:
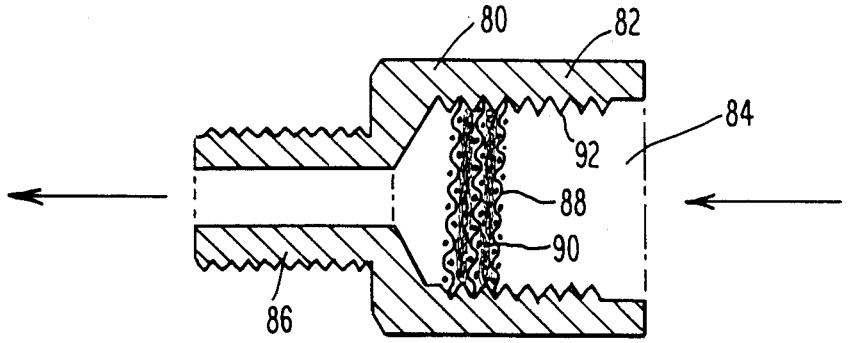
FIG. 5 is an enlarged view of the input portion of the sensor shown in FIG. 4.

In order to amplify the air pressure sensed in the region proximate web 10 a mechanical amplifier 80 is threadingly engaged in opening 56. Referring to FIG. 5, amplifier 80 is shown to include a member 82 having a cavity 84 formed therein having the same air pressure within cavity 84 as that in the region proximate web 10. Air pressure is transmitted through a bore in attachment portion 86 which bore establishes fluid communication between cavity 84 and opening 56. The air pressure signal is amplified, since the bore in attachment portion 86 is of a smaller diameter than cup portion 84. Such amplification allows for greater sensitivity of sensor 26. Amplifier 80 is also provided with a series of screens 88 having fiberglass 90 positioned therebetween to filter out particles contained in the dryer atmosphere. In the preferred embodiment screens 88 are 150 mesh screens. Additionally a number of edges 92 are provided on the inner surface of cup portion 82 which help reduce the resonance of moving air contained within cup portion 82.

While the invention has been described and illustrated with reference to specific embodiments, those skilled in the art will recognize that modification and variations may be made without departing from the principles of the invention as described herein above and set forth in the following claims. For example, it may be desirable to cancel out any effects of the air pressure within the pocket where the amplitude and frequenmcy of web flutter is being determined. In such situations two sensors can be utilized, wherein one sensor is positioned proximate web 10 and the other sensor is merely positioned within pocket 24 sensing the ambient air pressure within the pocket. In this fashion an air surge within the pocket will result in an electrical signal which can be utilized to cancel out both the air surge contribution to the air pressure and machine vibration which migrates to sensor 26 through support 28. To this end there is shown in FIG. 1 a second sensor 92, which is to be mounted in a fashion identical to sensor 26 for example on an extension rod for relative stationary positioning, is shown to also be mounted on frame 28 protruding into dryer pocket 24 in order to generate an electrical signal reflective of the amplitude and frequency of the air pressure within the dryer pocket. The electrical signal is carried by leads 92 to the processing components described in reference to FIG. 2. In this embodiment, processor 36 will substract the sensor 92 signal from the sensor 26 signal.

I claim:

1. An apparatus for determining the frequencies and amplitudes of flutter of a moving web in a web manufacturing operation, comprising:

sensor means for passively sensing the fluctuating air pressure in a region proximate said web without contacting the web and for generating a pressure signal representative of said fluctuating air pressure; and signal processing means, connected to receive said pressure signal, for determining the amplitude and frequency of said flutter from said pressure signal and for generating an indication signal representative of said amplitude and said frequency.

2. The apparatus of claim 1, further comprising indication means, connected to receive said indication signal for indicating the amplitude and frequency of said flutter.

3. The apparatus of claim 2, wherein said indication means comprises an oscilloscope.

4. The apparatus of claim 2, wherein said indication means comprises a graphic printer.

5. The apparatus of claim 2, wherein said indication means comprises a cathode ray tube display.

6. The apparatus of claim 1, wherein said pressure signal is a time domain signal and wherein said signal processing means comprises transformation means for transforming said pressure signal from said time domain to a transformation domain from which said amplitude and said frequency can be determined.

7. The apparatus of claim 6, wherein said transformation means comprises analysis means for performing a fast Fourier analysis on said pressure signal to transform said pressure signal from said time domain to a frequency domain.

8. The apparatus of claim 7,. wherein said analysis means comprises a computer and programming means for performing said fast Fourier analysis on said pressure signal.

9. The apparatus of claim 8, further comprising interface means, interposed between said sensor means and said analysis means, for receiving said pressure signal and for formatting said signal into a form capable of being operated upon by said computer.

10. The apparatus of claim 1, wherein said sensor means comprises a sensor which generates a modulated electrical signal reflective of changes in air pressure proximate said sensor, mounting means for mounting said sensor in a location proximate said web, and demodulaltion means, connected to receive said modulated electrical signal, for demodulating said modulated electrical signal and for generating said pressure signal reflective of the demodulated signal.

11. The apparatus of claim 10, wherein said sensor comprises a low differential pressure transducer.

12. The apparatus of claim 11, wherein said transducer comprises a diaphragm sandwiched between two body members defining cavities between said diaphragm and said body members, a pair of matched impedance coils mounted in said body members so that one coil is positioned on each side of said diaphragm, said coils being connected in series, and an opening formed in each body member for establishing fluid communication between that cavity whose opening is located to receive said air and for establishing a relatively constant air pressure in said other cavity.

13. The apparatus of claim 1, further comprising amplifying means, connected to said sensing means, for amplifying said pressure of air.

14. The apparatus of claim 13, wherein said sensor means includes a sensor having an opening for receiving said air, and wherein said amplifier means comprises a first member having a cavity formed therein for receiving said air, said cavity having an open end of a first diameter, and an attachment member connected to said first member, said attachment member having a bore passing therethrough, said bore providing fluid communication between said opening and said cavity, said bore having a second diameter smaller than said first diameter.

15. The apparatus of claim 14, wherein said first cup shaped member further comprises resonance reduction means for reducing the resonance of the air in said cavity.

16. The apparatus of claim 15, wherein said cavity defines an interior surface, and wherein said resonance reduction means comprises a plurality of edges formed on said interior surface.

17. The apparatus of claim 14, further comprising filter means positioned in said cavity.

18. The apparatus of claim 17, wherein said filter means comprises a number of screens positioned within said cavity.

19. The apparatus of claim 18, further comprising fiberglass disposed between said screens.

20. The apparatus of claim 12, further comprising a tube having open ends wherein one of said open ends is connected to said opening for establishing a relatively constant air pressure in said other cavity and wherein fiberglass is positioned within the other open end of said tube.

* * * * *